US009984548B2

(12) United States Patent
Kechichian

(10) Patent No.: US 9,984,548 B2
(45) Date of Patent: May 29, 2018

(54) METHOD AND DEVICE FOR PROVIDING AN ALARM

(71) Applicant: KONINKLIJKE PHILIPS N.V., Eindhoven (NL)

(72) Inventor: Patrick Kechichian, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days. days.

(21) Appl. No.: 15/538,933

(22) PCT Filed: Dec. 18, 2015

(86) PCT No.: PCT/EP2015/080485
§ 371 (c)(1),
(2) Date: Jun. 22, 2017

(87) PCT Pub. No.: WO2016/102363
PCT Pub. Date: Jun. 30, 2016

(65) Prior Publication Data
US 2017/0358191 A1 Dec. 14, 2017

(30) Foreign Application Priority Data
Dec. 22, 2014 (EP) ..... 14199734

(51) Int. Cl.
*G08B 21/02* (2006.01)
*G08B 25/00* (2006.01)
*G08B 25/01* (2006.01)

(52) U.S. Cl.
CPC ..... *G08B 21/02* (2013.01); *G08B 25/008* (2013.01); *G08B 25/01* (2013.01)

(58) Field of Classification Search
CPC ..... G08B 21/0213; G08B 21/0202; G08B 21/0446; G08B 21/0438
See application file for complete search history.

(56) References Cited

U.S. PATENT DOCUMENTS 4,170,897 A * 10/1979 Babcock ..... G01B 17/04 73/778
4,281,237 A * 7/1981 Berenson ..... H02H 5/043 219/212
5,295,490 A * 3/1994 Dodakian ..... A61B 5/1135 600/534
5,656,996 A 8/1997 Houser
5,666,961 A * 9/1997 McFarlin, Sr. ..... A61B 5/1135 600/534
6,551,252 B2 * 4/2003 Sackner ..... A61B 5/0205 600/301
6,561,987 B2 * 5/2003 Pail ..... A61B 5/1135 600/529
7,020,508 B2 * 3/2006 Stivoric ..... A61B 5/0205 600/390
7,150,048 B2 12/2006 Buckman
7,319,895 B2 * 1/2008 Klefstad-Sillonville ..... A41D 13/1281 600/388

(Continued)

*Primary Examiner* — Hai Phan
*Assistant Examiner* — Son M Tang

(57) ABSTRACT

There is provided a method and device (2) for providing an alarm (7) on request of a person (1). The person is wearing the device that is attached with attachment means (3, 4, 5) to the wrist or other part of the body. A pulling force (6) of the person acting on the device causes a change in an electrical characteristic of a component (301) included in the device. The change of the electrical characteristic is measured and when detected will result in an activation of the alarm.

11 Claims, 6 Drawing Sheets

(56) References Cited

U.S. PATENT DOCUMENTS

| | | | | |
|---|---|---|---|---|
| 8,034,001 | B2 * | 10/2011 | Gal | A61B 5/1135 600/534 |
| 8,381,603 | B2 | 2/2013 | Peng et al. | |
| 8,747,336 | B2 | 6/2014 | Tran | |
| 9,153,115 | B1 * | 10/2015 | Ulner | G08B 21/0446 |
| 9,211,085 | B2 * | 12/2015 | Streeter | A61B 5/0816 |
| 9,773,395 | B2 * | 9/2017 | Visweswara | A61B 5/6822 |
| 2004/0080421 | A1 | 4/2004 | Wunderlich | |
| 2006/0211951 | A1 * | 9/2006 | Milijasevic | A61B 5/204 600/547 |
| 2008/0000304 | A1 * | 1/2008 | Nagle | A61B 5/1135 73/780 |
| 2008/0006513 | A1 * | 1/2008 | Stolyar | B65G 43/02 198/810.01 |
| 2009/0121863 | A1 | 5/2009 | Prior | |
| 2010/0148975 | A1 | 6/2010 | Riley et al. | |
| 2011/0260594 | A1 | 10/2011 | Yang | |
| 2012/0105223 | A1 | 5/2012 | Weil | |
| 2012/0109575 | A1 | 5/2012 | Balbus et al. | |
| 2013/0021154 | A1 * | 1/2013 | Solomon | G08B 21/0453 340/539.12 |
| 2014/0150530 | A1 | 6/2014 | Ten Kate | |
| 2014/0191863 | A1 | 7/2014 | Ten Kate | |
| 2014/0276238 | A1 | 9/2014 | Osorio | |
| 2015/0064675 | A1 * | 3/2015 | Eichhorn | A61B 17/29 434/262 |
| 2015/0111558 | A1 * | 4/2015 | Yang | G04G 21/04 455/418 |
| 2016/0275771 | A1 * | 9/2016 | Visweswara | A61B 5/6822 |
| 2017/0356812 | A1 * | 12/2017 | Madden | G01L 1/144 |

* cited by examiner

METHOD AND DEVICE FOR PROVIDING AN ALARM

CROSS-REFERENCE TO PRIOR APPLICATIONS

This application is the U.S. National Phase application under 35 U.S.C. § 371 of International Application No. PCT/EP2015/080485, filed on Dec. 18, 2015, which claims the benefit of European Patent Application No. 14199734.6, filed on Dec. 22, 2014. These applications are hereby incorporated by reference in their entirety herein.

FIELD OF INVENTION

The invention is related to a method and device for providing an alarm on request of a person wearing the device and to a personal emergency response system comprising the device, wherein the device is attachable to the body of the person.

BACKGROUND OF THE INVENTION

Worldwide, the life expectancy of older people continues to rise. By 2020, for the first time in history, the number of people aged 60 years and older will outnumber children younger than 5 years of age. By 2050, the world's population aged 60 years and older is expected to total 2 billion, up from 841 million today (according to WHO report). This population needs continuous medical supervision and care.

Personal emergency response systems or devices, also referred to as PERS devices, promote the independence and improve the quality of lives of elderly and disabled members of the population by providing "anytime-anywhere" access to assistance provided by family or a professional alarm control center.

"Anytime" access requires that a PERS device is always operational and ready to output an alarm to a service provider in case of an emergency, "Anywhere" access means that the PERS device requires technologies that allow the service provider to communicate with and possibly locate the incapacitated person. Such technologies include communication technologies such as cellular, Wi-Fi, Bluetooth; and location technologies make (for example) use of a global positioning system (GPS) or Wi-Fi. The fact that the PERS device needs to be with the user at all times necessitates that the PERS device is attached to the neck or elsewhere on the body.

US2009121863 and US20140150530A1 disclose wearable PERS devices that have communication technologies for sending a help request to a professional alarm control center.

US20090121863 discloses a PERS device containing an emergency button that the person can press to call for help. However, in an emergency situation, the person may panic and be confused making it difficult for the person to properly press the emergency push button.

It is an object of the invention to provide a method of initiating an alarm that is simpler for a person in distress.

SUMMARY OF THE INVENTION

The object of the invention is achieved with the method of claim 1. The person is wearing the device, for example, by attaching it to the wrist or other part of the body.

In emergencies, the person may simply pull the device that is attached (with attaching means such as a cord, strap or belt) to the body of the person. Due to the imposed pulling force, an electrical characteristic of the component has changed. The change of the electrical characteristic is measured and when detected, it will result in the activating of the alarm.

In a further embodiment of the method according to claim 2, a time filter is used to prevent that an accidental pulling of the device causes an alarm. It may happen, for example, when the device accidentally hooks or is caught on an object (e.g. a table) during standing up that the exerted pulling force causes a change in the electrical characteristic. The time filter requires the pulling force to be present for a predetermined time period to be able to cause an alarm. Accidental pulling of the device shorter than the predetermined time period will not initiate an alarm, and thus there will be fewer false alarms. Additionally, in a further embodiment of the method, when the alarm is already activated, the person is informed with an audible, visual or tactile signal enabling him or her to revoke the alarm within a predetermined time.

The object of the invention is further achieved through the device of claim 4. The device is constructed so as to provide the alarm, on request of the person wearing this device.

The device comprises a housing and a cord attached to the housing. This type of construction allows hanging the device around the neck of the person while using the device. However, the housing may also be coupled with a strap while wearing the device on the wrist. The device can also be attached to the belt for wearing it around the waist.

Furthermore, the device comprises the component having an electrical characteristic. The component is connected with the cord, belt or strap and the housing in such way, that the electrical characteristic of the component changes, in response to the pulling force acting on the housing. The pulling of the housing is much easier and simpler for a person in distress than the pressing of a button.

In an embodiment of the device, the component is a mechanical switch. Depending on the pulling force that is imposed on the housing, the mechanical switch is closed or opened. This changes its electrical characteristic.

In a further embodiment of the device, the neck cord further includes a safety release mechanism to prevent the person from choking in case the neck cord is caught on an object. The neck cord further comprises a conductive material to allow a change in its electrical characteristic of the neck cord to be measured by a circuit included in the housing of the device. If the pulling force is strong enough to engage the safety release mechanism, then this contact break can be detected by the measuring circuit.

In another embodiment of the invention, the component has a shape that changes in response to the pulling force. The electrical characteristic depends on the change of the shape. The component may, for example, be a stretch sensor, a strain gauge or a strip of piezo electric material. A stretching of the strain gauge will cause its resistance to change and a bending of the strip of piezo electric material will result in a voltage generation. These sensors illustrate that the electrical characteristic is dependent on a force acting of the component. This force acting on the component originates from the person pulling the housing of the device.

In a further embodiment of the device, the neck cord includes a stretch sensor. The neck cord further comprises conductive material to allow a change in the electrical characteristic of the stretch sensor to be measured by a circuit included in the housing of the device. When the person imposes a pulling force on the housing the stretch sensor is stretched and the change of its electrical characteristic is conducted by the neck cord to the circuit in the housing.

Due to the elastic limit of the stretch sensor, special attention has to be paid to proper design of the neck cord, so that the sensor is not stretched beyond its elastic limit. In a further embodiment, the neck cord or only the stretch sensor is put inside a flexible tube. The tube is less stretchable than the cord (or not stretchable) and has a predetermined length, which limits the stretching of the stretch sensor beyond its elastic limit. In an embodiment, the tube may be covering the cord as well as the component and be attached to the housing, so that the cord and the component are not visible. In a further embodiment only the stretch sensor is inside the tube.

In a further embodiment the exterior surface of the housing is covered with conductive strips or elements. When the person grasps the housing to initiate an alarm his or her hand touches the conductive strips so that in addition to a change in the electrical characteristic of the component an impedance change measured between the strips may be measured. This measured impedance change may be used to distinguish by the person pulling the housing and an accidental pulling caused by the device hooking to an object. In this embodiment the device activates the alarm only when both a change in the electrical characteristic of the component and a change in the impedance between the conductive strips have been measured.

In a further embodiment the device is wireless coupled to a base unit, the base unit being coupled to a PC or phone at a remote location (e.g. an alarm control center). The base unit may be a two-way hands free audio terminal. The alarm, when activated by person using his or her wearable device, is first sent to the base unit. Next the base unit transmits the alarm to the PC or phone at the remote location (e.g. the alarm control center).

BRIEF DESCRIPTION OF THE DRAWINGS

These and other aspects of the disclosed method and device are described in detail with reference to the following figures, wherein.

DETAILED DESCRIPTION OF EMBODIMENT

Figure 1:
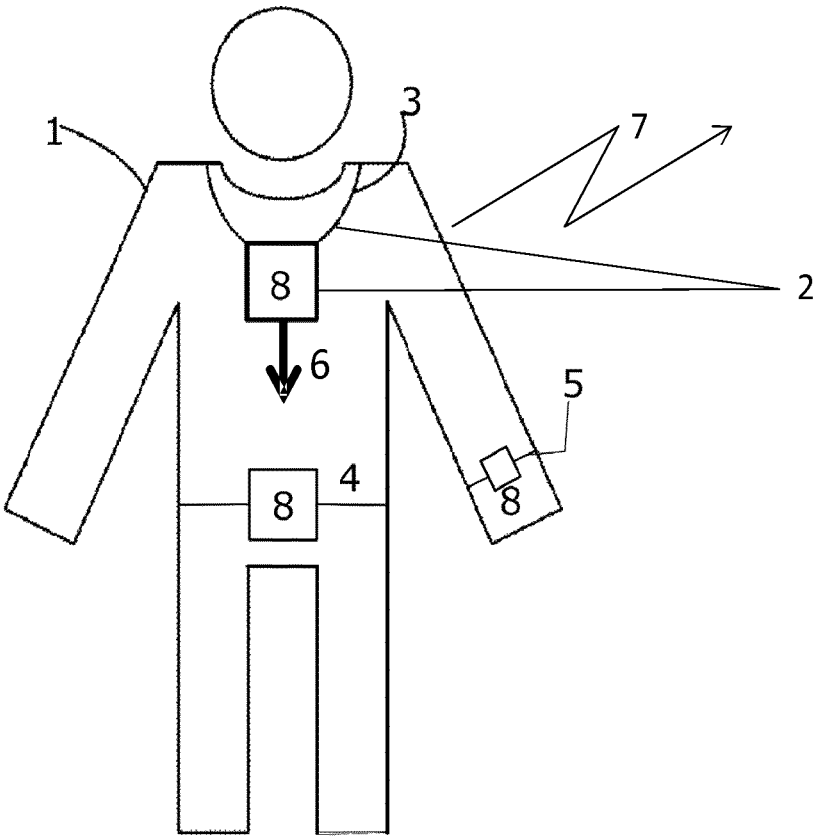
FIG. 1 shows a personal emergency response device for providing an alarm that is worn by a person.

As shown in FIG. 1, the invention provides a personal emergency response device for providing an alarm 7 that is to be worn by a subject as a person 1. In the illustrated embodiment, the device comprises a housing 8 with a neck cord 3 for placement of the device around the person's neck. Alternatively, the device can be arranged to be worn at or on a different part of the body such as the wrist or waist and will comprise a suitable arrangement for attaching the housing 8 to that part of the body (for example a belt 4 or a strap 5).

Figure 6:
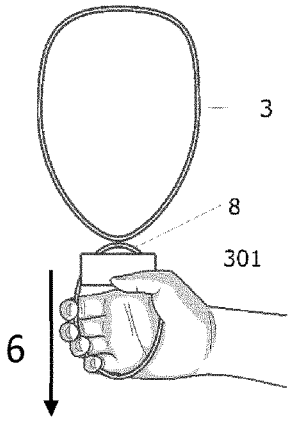
FIG. 6 shows the person pulling the housing to initiate the alarm.

The device is used for providing the alarm 7 at the request of the person 1, who has lost finger functionality due to stress or other reasons and cannot properly press the emergency push button. The invention provides an easy and convenient method for initiating the alarm 7 just by pulling the housing of the device with a pulling force 6 acting on housing as shown in FIG. 6. For a person in distress it is easier to put his fingers around the housing, and pull it, than to search for a button somewhere on the housing of the device.

Figure 3:
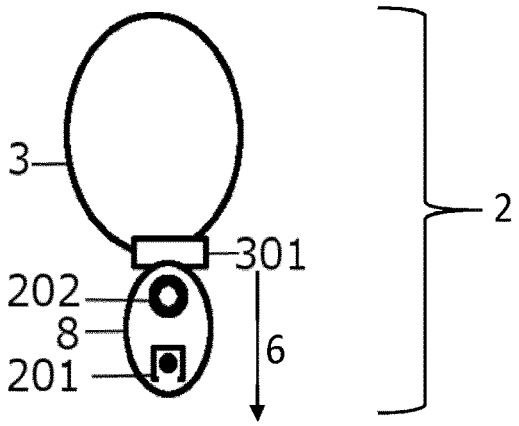
FIG. 3 shows an embodiment of the device for providing the alarm.

FIG. 3 shows one of the possible embodiments of the device 2 in accordance with the invention. The device comprises a cord (or other attachment means for attaching the device to the body), a housing and a component having an electrical characteristic that depends on a force acting on it. In response to the pulling force 6 acting on the housing 8 a force is exerted on the component causing its electrical characteristic to change. The device may further comprise a circuit for detecting the change in the electronic characteristic and if it exceeds a predetermined threshold the alarm 7 is activated.

Figure 4:
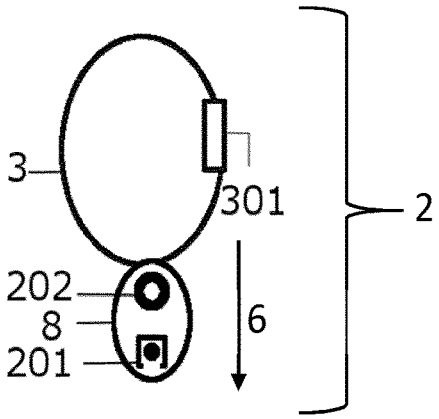
FIG. 4 shows a further embodiment of the device for providing the alarm.

As shows in FIG. 3 and FIG. 4 in a further embodiment the device may have a button 201 present on the housing to cancel an alarm that was accidently initiated. Alternatively, the device may comprise an accelerometer and the person may "shake" the device to revoke the alarm, the device being arranged to detect the "shaking" in response to data obtained with the accelerometer. In a further embodiment in addition the device may have an indicator to warn the person that the alarm was activated. The indicator may provide an audible, visual or tactile signal 202 and to give feedback to the person that the device is operational and has initiated the alarm.

Figure 5:
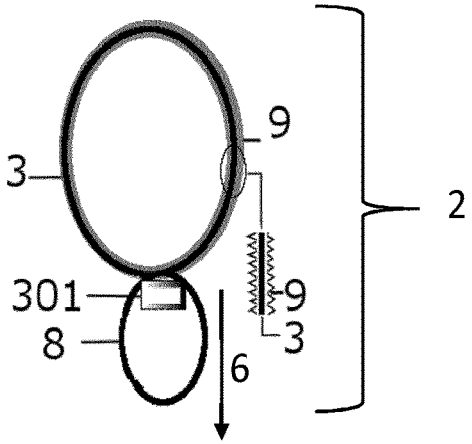
FIG. 5 shows another embodiment of the device for providing the alarm.

The component 301, is coupled to housing and may be situated as shown FIG. 3 outside of the housing. Further the component is also coupled to the cord. When the person pulls the housing while it is attached to the body of the person a force will act on the component thereby changing the electrical characteristic. In another embodiment the component is included inside the housing as shown in FIG. 5.

The device operates according to the method shown in FIG. 2 which will now be explained in detail.

Figure 2:
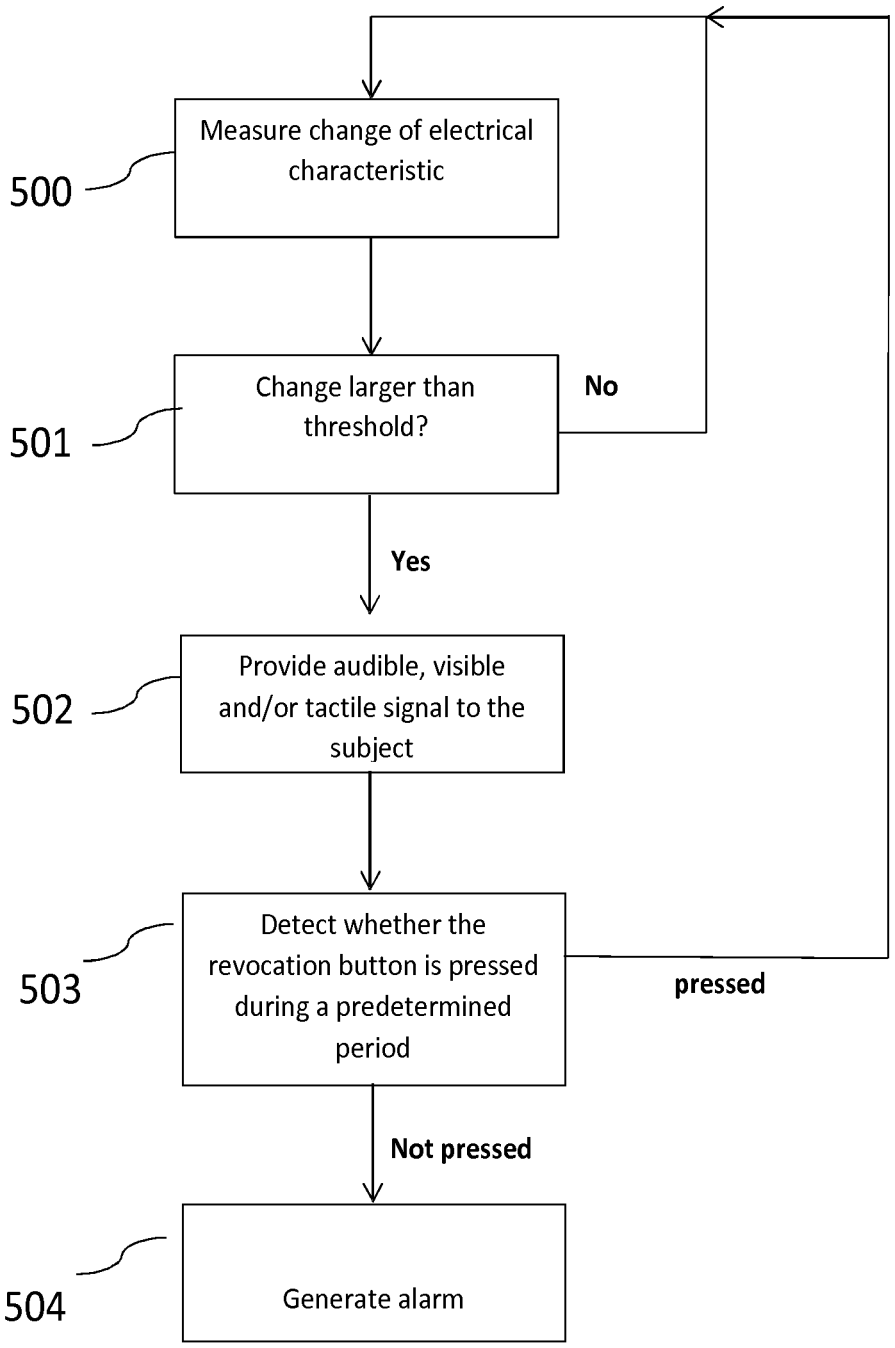
FIG. 2 shows a block diagram illustrating a method of providing the alarm.

FIG. 2 shows a block diagram illustrating an embodiment of the method of providing the alarm.

The method of providing the alarm on request of a person wearing the device comprises the following steps:

- a first step 500 of measuring a change in the electrical characteristic of the component;
- a second step 501 of detecting the pulling force 6 in response to the measured change;
- a final step 504 of providing the alarm 7 in response to detection of the pulling force.

Additional steps may be added in different embodiments of the method, see FIG. 2. For example the change of the electrical characteristic may be compared with a threshold. In this case the threshold is determined by a time filter. When the time during which the pulling force is present is shorter than a predetermined time the housing may have accidently pulled while the person had no intent to request for assistance ("nothing happened") and the device will continue detecting a potential change of the characteristic of the electrical characteristic.

However, in a further embodiment of the method, when the detected change exceeds the threshold (e.g. is present sufficiently long or has a value sufficiently large) the device 2 will provide an audible, visual or tactile signal to the person 502.

Furthermore in a further embodiment in a step 503 an additional condition is checked before an alarm will be initiated. If the person presses the revocation button 201 during a predetermined period after the signal is provided the alarm is revoked and the device will continue with detecting a potential change of the electrical characteristic (e.g a resistance of a stretch sensor or a voltage generated by a piezo electric component as will be explained in more detail later).

If the revocation button is not pressed during the predetermined period the alarm is generated 504.

Figure 9:
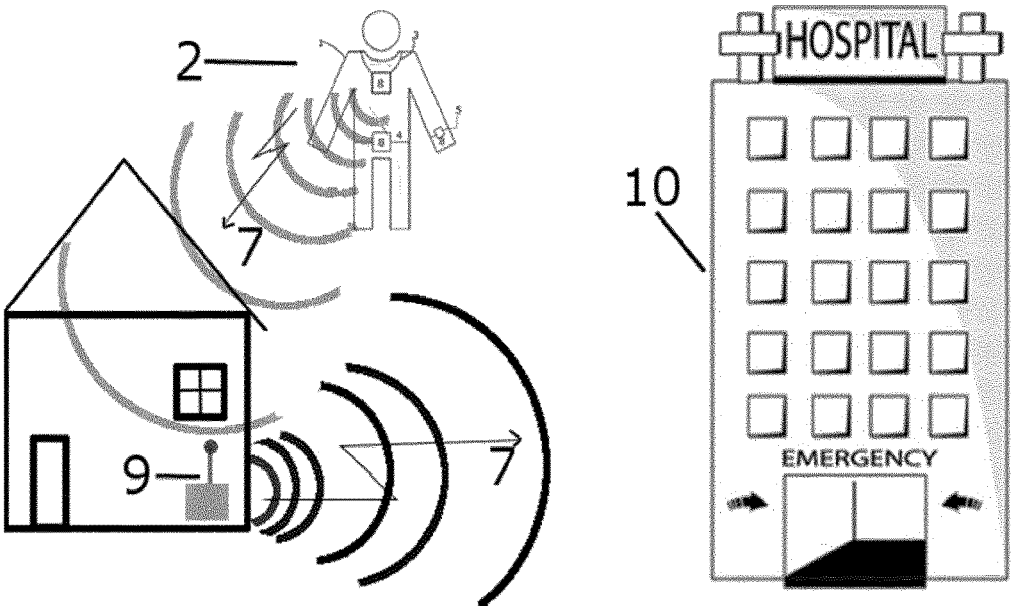
FIG. 9 shows an embodiment of a personal emergency response system comprising a personal emergency response device according to the invention.

In an embodiment the device itself also provides a further audible alarm to catch the attention of people close by. Moreover, in another embodiment, the alarm is wirelessly sent to an alarm control center as shown in FIG. 9. In yet a further embodiment the device 2 is coupled to a base unit 9. The device and base unit are included in a PERS system. The base unit 9 is arranged to act as a two-way hands free audio terminal. In case the person pulls the housing of the device to request for help the alarm is transferred to the base unit and from the base unit via internet, mobile or a landline to the alarm control center.

Figure 7:
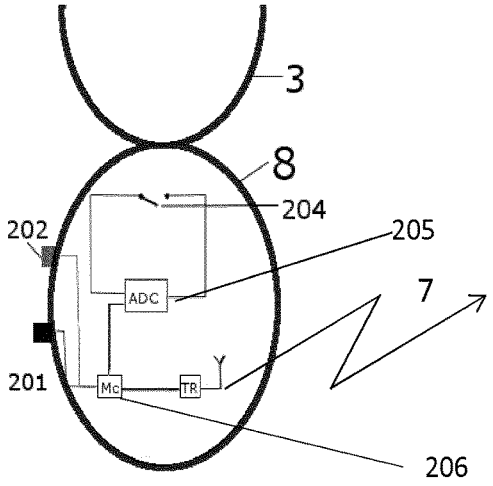
FIG. 7 shows an embodiment of the component included in an embodiment of the device.

FIG. 7 shows an embodiment of the component 301, 303 wherein the component is a mechanical switch 204 coupled to the cord 3 and to the housing. When the person pulls the device which is attached to the body of the person, a force is exerted on the mechanical switch causing it to be opened or closed. In an embodiment the pulling force may cause the mechanical switch to close which may be measured by an electronic circuit as shown in FIG. 7. The electronic circuit for example may comprise a power supply, an ADC converter 205, a microcontroller 206, and a transmitter to send the alarm to the base unit.

In another embodiment (see FIG. 3, 4, 5, 6, 7, 12) the component 301, 303 has a shape that changes in response to the pulling force, wherein the electrical characteristic is dependent on the shape or the change of the shape.

Numerous sensors exist for measuring strain or elastic deformation of materials, for example a stretch sensor, a strain gauge or a force/flex sensor. All of these sensors are based on the principle that stretching or compressing a conductive material causes its resistance to change. As the material is stretched its particles are spaced further apart, increasing the resistance. Conversely, as the material is compressed these particles are brought closer together resulting in a decrease in resistance or an increase in conductance.

Elasticity is defined as the ability of a material to return to its original form or shape after a stress/force has been applied to it. The ease with which an elastic material will stretch is determined by a parameter known as the modulus, which defines the amount of stress or force per unit area to stretch the material. A low modulus means that the material is easy to stretch. A second important parameter is the elastic limit, or the minimum force for which the material ceases to be elastic, i.e. does not return to its original state.

As shown in the embodiments of FIGS. 4 and 5 a neck cord includes a stretch sensor and conductive material to enable a measurement of the electrical characteristic of the component by a circuit in the device. When the stretch sensor is stretched due to the person exerting a pulling force on the housing, the change of its electrical characteristic may be measured. Due to the modulus and elastic limit of the stretch sensor, care has to be taken to properly design the neck cord so that the sensor is not stretched beyond its elastic limit.

In a further embodiment of the device shown in FIG. 5 the neck cord comprises the stretch sensor which is positioned inside a flexible tube 9. The advantage of this embodiment is that the tube prevents a stretching of the component beyond its elastic limit. The tube is less stretchable than the cord and has a predetermined length which limits the stretching of the stretch sensor beyond its elastic limit. In an embodiment the tube may be covering the cord and the component and be coupled to the housing, such that the conductive cord and the component are not visible. In a further embodiment only the stretch sensor is inside the tube 9.

In another embodiment the component comprises piezo elastic material. A pulling force acting on the housing causes a change in the shape of the component, which results in a change of the electrical characteristic of the piezo elastic material. For example a strip of piezo elastic material may provide a voltage in response to a bending of the strip, the amplitude of the voltage being dependent on the value of the pulling force.

Figure 8:
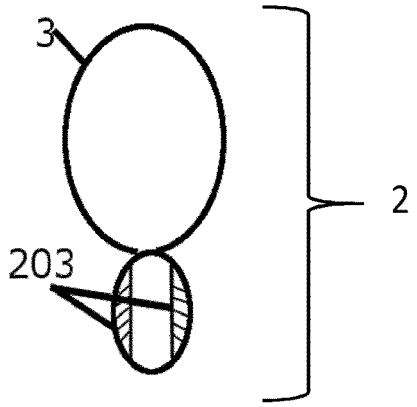
FIG. 8 shows a further embodiment of the device for providing the alarm.

FIG. 8 shows yet a further embodiment of the device 2. The outside of the housing 8 is covered with two conductive elements 203 that are not in contact with each other, but that both will be touched by the hand of a person that grasps the housing to request for assistance. A further circuit included in the device measures the impedance between the conductive elements and in response to a measured impedance change the alarm is activated. In a further embodiment the impedance change is only measured after a change in the electrical characteristic of the component has been measured and the alarm is only initiated when both changes have been detected.

As discussed above the device may contain a circuit to detect any changes in the electrical characteristic of the component. Such a circuit may for example comprise a voltage divider or a Wheatstone bridge, both known from prior art. In an embodiment the component may be a stretch sensor having a resistance. Stretching causes the resistance to change and this change may be measured using for example the voltage divider circuit.

Figure 10:
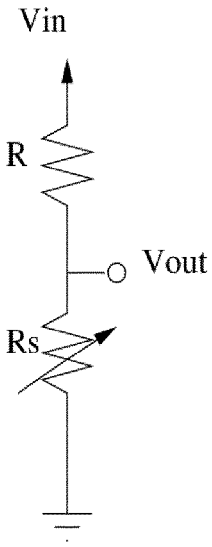
FIG. 10 shows an embodiment of a circuit for measuring the electrical characteristic of the component.

In the voltage divider circuit the stretch sensor is placed in series with a resistor having a known resistance value and the measured voltage across the stretch sensor is used to estimate the unknown resistance of the stretch sensor (unknown, as it is dependent on the pulling force which may be exerted on the housing). FIG. 10 shows the measuring circuit according to one embodiment of the circuit.

The voltage divider equation is given by $$Vout = \frac{Rs}{Rs + R} Vin, \tag{1}$$

where R and R correspond to the sensor's resistance and reference resistance, respectively. Vin and Vout correspond to the supplied input voltage and measured output voltage, respectively. Therefore, as the sensor is stretched, the measured resistance Rs also increases and thus also Vout will increase. If we let Ro denote the sensor's resistance when no force is applied, then Rs and R can be written as $$R=\alpha Ro$$

$$Rs=(1+k_s x)Ro$$

where $\alpha$ relates the reference resistance to the sensor's resistance without a force or stressor applied, and the constant $k_s$ relates the length increase x of the sensor to its resistance. Here the change in resistance is a linear function of the length increase x.

Substituting the expressions for R and Rs in the equation for Vout (1), the sensitivity with respect to the displacement can be computed, $$S = \frac{dVout}{dx} = \frac{\alpha}{(1 + k_s x + \alpha)^2} Vin. \tag{2}$$

It can be shown that the maximum sensitivity occurs for $\alpha=1+k_s x$, i.e. when the resistances are matched. Since x is a variable, this means that R should be close to Ro.

Rearranging terms and assuming that Vout can be measured, e.g. with an Analog-to-Digital converter (ADC) The change of electrical characteristic represented by Rs could be calculate from beloved formula:

$$Rs = \frac{Vout}{Vin - Vout} R. \tag{3}$$

Therefore, as the sensor is stretched, Vout will increase, and thus the measured resistance Rs also increases. The measured value of Rs can also be averaged over time to attenuate the influence of sensor noise. In the voltage divider embodiment, either Vout or Rs can be used as a measure of stretch or force applied to the cord.

Figure 11:
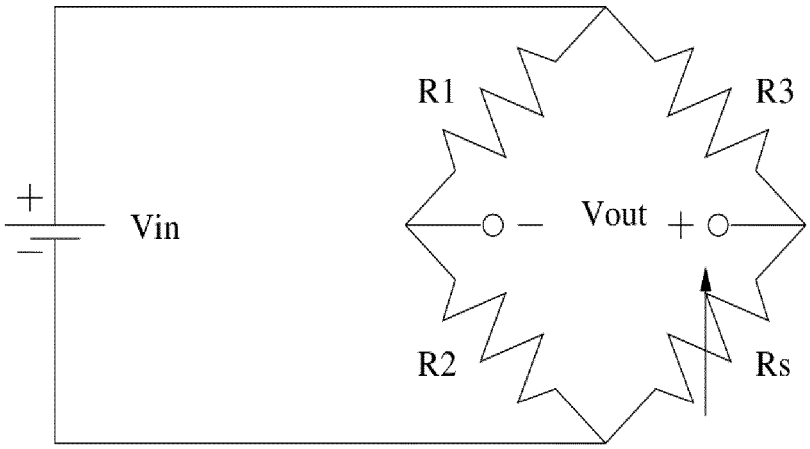
FIG. 11 shows a further embodiment of a circuit for measuring the electrical characteristic of the component.
Figure 12:
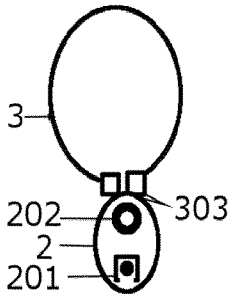
FIG. 12 shows a further embodiment of the device for providing the alarm.

In another embodiment of the circuit, measuring the stretch/strain gauge sensors resistance is achieved using a Wheatstone bridge which consists of two voltage divider circuits in parallel as shown in FIG. 11.

In this case, the output voltage, Vout is given by where R1, R2, R3 are reference resistors. (see FIG. 11)

$$Vout = \left(\frac{Rs}{R3 + Rs} - \frac{R2}{R2 + R1}\right) Vin \tag{4}$$

Assuming that the bridge is operating near its balance point, with $$\alpha = \frac{R1}{R2} = \frac{R3}{Ro}, \tag{5}$$

the sensitivity of the Wheatstone bridge is identical to the voltage divider. In contrast, the Wheatstone bridge's output does not contain a large DC component due to taking the difference between the parallel voltage dividers and thus its output/sensitivity can be boosted by applying an amplifier.

Because a stretch/strain gauge sensors and the materials to which they are adhered to are sensitive to temperature (i.e. they stretch or compress with changes in temperature), it is common practice that the load resistor R in the voltage divider and R3 in the Wheatstone bridge circuit is replaced by an identical reference stretch/strain gauge sensor placed on the same material that does not undergo any compression or expansion.

Taking the Voltage divider example, if $R=Ro\cdot(1+k_T T)$, where now the influence of the temperate T has been included with the constant $k_T$. Then $Rs=(1+k_s x)(1+k_T T)Ro$, and the effects of temperature cancel out in (1).

In a further embodiment of the device the measured resistance of the stretch sensor is used to detect a potential fall of the person.

To interpret the measured resistance Rs either via a simple voltage divider or Wheatstone bridge and incorporate it into a fall detection algorithm, it is important to establish the baseline resistance Ro, e.g. when the sensor is not under strain, and a second baseline when the pendant device is being properly worn, i.e. Rp>Ro due to the weight of the pendant device.

When the measured resistance Rs is closer to Ro, it indicates that the person is in a supine position, since the weight of the pendant device does not exert a force on the stretch/strain gauge sensor, indicating that the person may have fallen. Alternatively when the measured resistance Rs is approximately equal to Ro this may be indicating that the person is not wearing the device.

In a further embodiment of the device the component used is a stretch sensor or a strain gauge sensor and the device determines whether the person is in a supine position in dependence of a measured electrical characteristic of the stretch sensor.

In a further embodiment the device further comprises an accelerometer. If the low value for Rs was preceded by an impact measured by an accelerometer, it is highly probably that the person has fallen.

Similarly, if the measured value of Rs far exceeds the value of Rp, i.e. $Rs=\beta Rp$ for $\beta>1$, the system may interpret this as the user pulling on the housing device to signal for help.

Therefore, in the two aforementioned scenarios, an emergency call should be initiated to the call center.

While the invention has been illustrated and described in detail in the drawing and foregoing description, such illustration and description are to be considered illustrative or exemplary and not restrictive; the invention is not limited to the disclosed embodiments.

Variations to the disclosed embodiments can be understood and effected by those skilled in the art practicing the claimed invention, from a study of the drawings, the disclosure, and the appended claims. In the claims, the word "comprising" does not exclude other elements or steps, and the indefinite "a" or "an" does not exclude a plurality. A single processor or other unit may fulfill the function of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A wearable personal emergency response device for providing an alarm, the device comprising:

a housing;

a strap coupled to the housing for wearing in use the device attached to a wrist of a user, a belt coupled to the housing for wearing in use the device attached to a waist of a user, or a cord coupled to the housing for wearing the device around a neck of a user; wherein the device further comprises a component having an electrical characteristic, the housing is further coupled to the component, the electrical characteristic being changeable in response to a pulling force acting on the housing; and wherein the device is arranged to provide the alarm in response to a measured change in the electrical characteristic of the component, wherein the outside of the housing comprises two or more conductive elements; the device being arranged to measure an impedance between the conductive elements; and wherein the alarm is activated further in response to a detected change of the impedance between the elements.

2. The device according to claim 1, wherein the component is a mechanical switch that is further coupled to the strap, the belt or the cord, wherein in use the mechanical switch is closed or opened in dependence of the pulling force acting on the housing.

3. The device according to claim 1, wherein the component has a shape that is changeable in response to the pulling force acting on the housing wherein electrical characteristic is dependent on the shape.

4. The device according to claim 3, wherein the component is coupled via the strap, the belt or the cord to the housing; the strap, the belt or the cord further comprising conductive material to provide an electrical connection to the component to enable the measuring of a change in the electrical characteristic.

5. The device according to claim 4 wherein the component is positioned inside a tube, the tube being flexible and less stretchable than the component; the tube being coupled to the housing and having a predetermined length limiting the stretching of the component, when in use the pulling force acts on the housing.

6. The device according to claim 1, wherein the component comprises elastic material.

7. The device according to claim 6, wherein the elastic material comprises piezo elastic material or a strain gauge.

8. The device according to claim 1, further comprising a time filter for suppressing the alarm when the pulling force acting on the housing is shorter than a predetermined time period.

9. The device according to claim 1, comprising a user interface for revoking the alarm and the device is further arranged to provide an audible, visual or tactile signal in response to an activation of the alarm.

10. The device according to claim 1 wherein the component is a stretch sensor and wherein the device is arranged to provide an indication of a potential fall of a person in response to a measured electrical characteristic of the stretch sensor.

11. A personal emergency response system comprising the device according to claim 1 and a base unit, wherein the device is coupled to the base unit which is arranged to act as a two-way hands free audio terminal, the base unit being coupled to an alarm control center for transferring the alarm received from the device to an alarm control center.

* * * * *